US005562999A

United States Patent [19]

Grunke et al.

[11] Patent Number: 5,562,999

[45] Date of Patent: Oct. 8, 1996

[54] COMPONENT MADE OF AN INTERMETALLIC COMPOUND WITH AN ALUMINUM DIFFUSION COATING

[75] Inventors: Richard Grunke, Muenchen; Lothar Peichl, Dachau; Walter Heinrich, Friedberg; Horst Pillhoefer, Roehrmoos; Frank Brungs, Dachau, all of Germany

[73] Assignee: MTU Motoren-und Turbinen-Union Muenchen GmbH, Munich, Germany

[21] Appl. No.: 362,586

[22] PCT Filed: Jul. 7, 1993

[86] PCT No.: PCT/EP93/01765

§ 371 Date: Mar. 9, 1995

§ 102(e) Date: Mar. 9, 1995

[87] PCT Pub. No.: WO94/01594

PCT Pub. Date: Jan. 20, 1994

[30] Foreign Application Priority Data

Jul. 7, 1992 [DE] Germany ..... 42 22 211.7

[51] Int. Cl.[6] ..... B32B 15/20; C22F 1/18

[52] U.S. Cl. ..... 428/651; 428/660; 428/654; 148/525; 148/537; 416/241 R

[58] Field of Search ..... 428/610, 651, 428/654, 660; 148/525, 537; 427/320; 416/241 R

[56] References Cited

U.S. PATENT DOCUMENTS

| | | | |
|---|---|---|---|
| 2,903,785 | 9/1959 | Hamink et al. | 428/651 |
| 2,920,007 | 1/1960 | Buckland | 416/241 R |
| 3,615,279 | 10/1971 | Ward | 428/651 |
| 3,804,679 | 4/1974 | Streel | 148/525 |
| 4,168,183 | 9/1979 | Greenfield et al. | 428/660 |
| 4,824,482 | 4/1989 | Baldi | 428/651 |
| 4,830,265 | 5/1989 | Kennedy et al. | 148/525 |
| 5,300,159 | 4/1994 | Petzoldt et al. | 148/525 |

FOREIGN PATENT DOCUMENTS

| | | |
|---|---|---|
| 3742721 | 12/1988 | Germany . |
| 3193839 | 11/1991 | Japan . |
| 3249147 | 2/1992 | Japan . |

*Primary Examiner*—John Zimmerman
*Attorney, Agent, or Firm*—Evenson, McKeown, Edwards & Lenahan, P.L.L.C.

[57] ABSTRACT

A component made of an intermetallic compound of titanium and aluminum, or of alloys of such intermetallic compounds with alloying additions forming the base material, and with an aluminum diffusion coating on the base material, is provided. The component has, between the base material and the aluminum diffusion coating, a closed zone which is close to the surface and has a recrystallization structure. For this purpose, the component is cold-formed or slightly melted in a zone which is close to the surface, is then annealed at the recrystallization temperature, and finally has an aluminum diffusion coating applied to the recrystallized zone. The process is used for components in engines and, particularly, for components in the hot-gas duct of an engine.

17 Claims, 3 Drawing Sheets

COMPONENT MADE OF AN INTERMETALLIC COMPOUND WITH AN ALUMINUM DIFFUSION COATING

BACKGROUND AND SUMMARY OF THE INVENTION

The invention relates to a component made of an intermetallic compound consisting of titanium and aluminum or made of alloys of such intermetallic compounds with alloying additions so as to form the base material and with an aluminum diffusion coating on the base material.

This base material has interesting characteristics for the construction of engines. It has mechanical characteristics which are comparable to those of conventional titanium alloys while the specific weight is low, but can be used at significantly higher operating temperatures. However, the ductility of this base material at room temperature is lower and must therefore be improved by the use of alloying elements and heat treatment processes, as they are known from German Patent document DE 30 24 645.

While, in the case of conventional titanium alloys, an oxygen embrittlement in an oxidizing atmosphere begins at temperatures starting at 550° C., in the case of intermetallic compounds made of titanium and aluminum, this temperature is at 700° C. The oxygen embrittlement is disadvantageous because the already low ductility further deteriorates at room temperature and results in a brittleness which is known with respect to ceramic components.

In order to use this base material for components which are subjected to operating temperatures of 700° C., as occur preferably in the case of components in the compressor and turbine range of engines, a closed and no-defect aluminum diffusion coating is required on the high-temperature-stressed component surfaces.

When conventional aluminum diffusion coatings are used on components made of the base material, no closed aluminum diffusion coating is achieved. Disadvantageously, coating defects occur. These coating defects include areas of extremely non-uniform coating thicknesses such as trough-shaped coating structures which have no coating on the bottom of the trough. When the coating is extremely thick, these troughs and defects can be covered with aluminum. However, when the component is stressed, these areas will disadvantageously break open and the aluminum covering will chip off.

It is an object of the present invention to provide a component of the above-mentioned type, and a process for its manufacture, in which no coating defects occur and which can be used at operating temperatures of 700° C.

According to the present invention, this object is achieved in that, between the base material and the aluminum diffusion coating, the component has a closed zone which is close to the surface and has a recrystallization structure.

As determined in comprehensive development work, a closed aluminum diffusion coating grows in an undisturbed and uniform manner only on such a recrystallization structure of an intermetallic compound base material consisting of titanium and aluminum, or of alloys of such intermetallic compounds with or without alloying additions. The advantages of the invention are that the application range of such base materials is significantly expanded, and conventional technologies and processes which are suitable for mass production can be used for producing such components.

In the case of a preferred embodiment of the invention, the intermetallic compound is TiAl. In the case of this base material, it could be determined that crystallites with a high stacking fault density occur in the form of crystallographic twin planes in the crystallite. These crystallites exhibit a plate structure, as has not been observed in the case of conventional titanium alloys. In the case of conventional aluminum diffusion coatings, the twin planes remain uncoated. It is only after a zone is formed which is close to the surface and has a crystallization structure that components made from the base material could be represented with a closed aluminum diffusion coating.

A particularly high density of crystalline plate structures is exhibited by base materials made of alloys from intermetallic compounds with a constituent of TiAl of between 50 and 95% by volume and with a $Ti_3Al$ constituent of between 5 and 50% by volume. In the case of components made of critical base materials, which have a higher proportion of titanium than TiAl and, therefore, tend to have more oxygen embrittlement, uniformly thick aluminum diffusion coatings can be implemented in an advantageous manner through the use of the closed zone according to the invention. The closed zone is close to the surface and consists of a recrystallization structure.

For improving the ductility of the components made of intermetallic compounds, preferably up to 4% alloying additions made of niobium, tantalum, tungsten, vanadium, or mixtures thereof are contained in the component material.

The depth of the closed zone which is close to the surface and has a recrystallization structure amounts to at least 0.1 μm. A recrystallization structure depth between 1 and 10 μm was found to be practical because it can be prepared in a low-cost manner, preferably by using a cold forming which is close to the surface. Recrystallization structure depths between 0.1 and 1 μm are preferably implemented by laser melting and recrystallizing close to the surface. In the case of recrystallization structure depths of above 100 μm, the risk increases that large-volume crystallites with a plate structure are formed during the recrystallization which would prevent a closed aluminum diffusion coating.

A process according to the present invention for producing the components of the above-mentioned type is achieved by the following process steps. The component is cold-formed or slightly melted in a zone which is close to the surface. The component is then annealed at the recrystallization temperature, and finally an aluminum diffusion coating is applied to the recrystallized zone. This process has the advantage that low-cost process steps are provided which are suitable for mass production so that components can be used in engine construction which are improved in a low-cost manner.

For the surface cold forming, a shot peening or machining of the surface areas of the component to be recrystallized is preferably carried out. During shot peening, the component is blasted by ceramic balls made of $Al_2O_3$, by glass beads, or by steel balls. In this case, the crystalline structure of the base material is disturbed and internal stress enters into the surface of the base material. During the subsequent recrystallization annealing below the melting temperature of the material, a finely crystalline recrystallization structure is formed on which an aluminum diffusion layer can grow in an undisturbed manner. For surface areas which are not to be coated, protective measures must be taken during the shot peening such as using covers or screens.

For the machining or cold forming close to the surface, pressure rollers, presses, rollers, striking tools or pressure grinding tools may be used.

Preferably, the recrystallization structure may also be formed by the fact that, in the areas which finally are to be coated with aluminum, the surface of the component is first rastered by using a laser beam. In the process, the surface is slightly melted. This has the advantage that particularly low depths of the recrystallization structure between 0.1 and 1 μm can be implemented and the surface areas can be rastered, melted and recrystallized in a geometrically exact manner without using any additional protective measures.

In the case of a preferred implementation of the process, a recrystallizing and an aluminum diffusion coating is carried out using a heat cycle in that first the component, which is cold-formed on the surface or slightly melted on the surface and solidified, is heated to the recrystallization temperature in a system for aluminum diffusion coating. After the recrystallization has taken place, the temperature is set for the aluminum diffusion coating and the transmitted aluminum-containing gas is supplied at the same time.

This implementation of the process fully utilizes the technical conditions of a system for aluminum diffusion coating because, in such systems, the component can be heated independently of the coating process. In addition, contamination danger is reduced because there is no removal or modification between the recrystallization annealing and the coating. This also reduces the cost of the process.

Preferably, the component is subjected to a reduced pressure or to a protective atmosphere during recrystallization so that the heat cycle to the feeding of the aluminum-containing donor gas takes place under a protective gas or at a reduced pressure. This has the advantage that the component surfaces continue to be protected from impurities and oxidation processes.

The powder pack process is known for the aluminum diffusion coating of structural members made of an iron base alloy, a nickel base alloy or a cobalt base alloy. In addition, many different aluminum donors are used for generating aluminum donor gases. The preferred process for the aluminum diffusion coating is the powder pack process, and an aluminum donor of the ternary alloy Ti/Al/C is used for generating a donor gas. In this case, the carbon constituent has the effect that the residual oxygen concentrations remaining in the powder pack are bound or neutralized by use of carbon monoxide formations or carbon dioxide formations, whereas Ti and Al correspond to the base material and therefore promote the growth process of an aluminum diffusion coating on the base material.

The figures illustrate embodiments for an aluminum diffusion coating of components made of intermetallic compounds of titanium and aluminum.

Other objects, advantages and novel features of the present invention will become apparent from the following detailed description of the invention when considered in conjunction with the accompanying drawings.

DETAILED DESCRIPTION OF THE DRAWINGS

Figure 1:
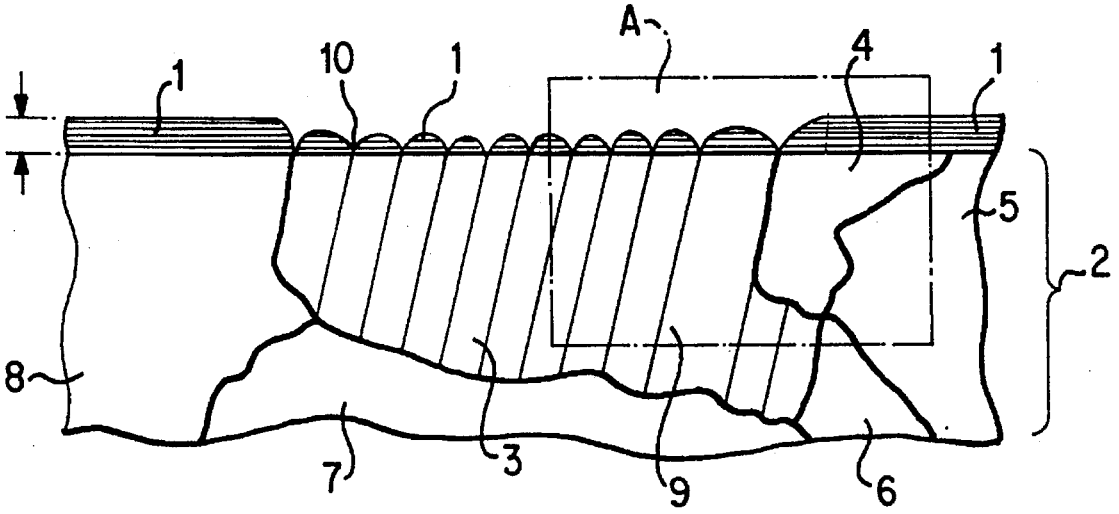
FIG. 1 PRIOR ART
FIG. 1 is a schematic view of an aluminum diffusion coating of components made of intermetallic compounds of titanium and aluminum without any zone close to the surface and which has a recrystallization structure.

FIG. 1 illustrates an aluminum diffusion coating 1 of components made of intermetallic compounds of titanium and aluminum without a zone which is close to the surface and which has a recrystallization structure, the base material 2 being solidified in large-volume crystallites 3 to 8. One of the crystallites 3 exhibits a pronounced plate structure with stacking faults in the form of twin planes 9. On the lines 10 of these fault points intersecting along the surface, the aluminum diffusion coating has trough-shaped faults. A faultless coating is found only on the crystallites 4, 5 and 8 which have no plate structure. The outlined cutout A was examined by means of a metallographic section. The result is illustrated in FIG. 2.

Figure 2:
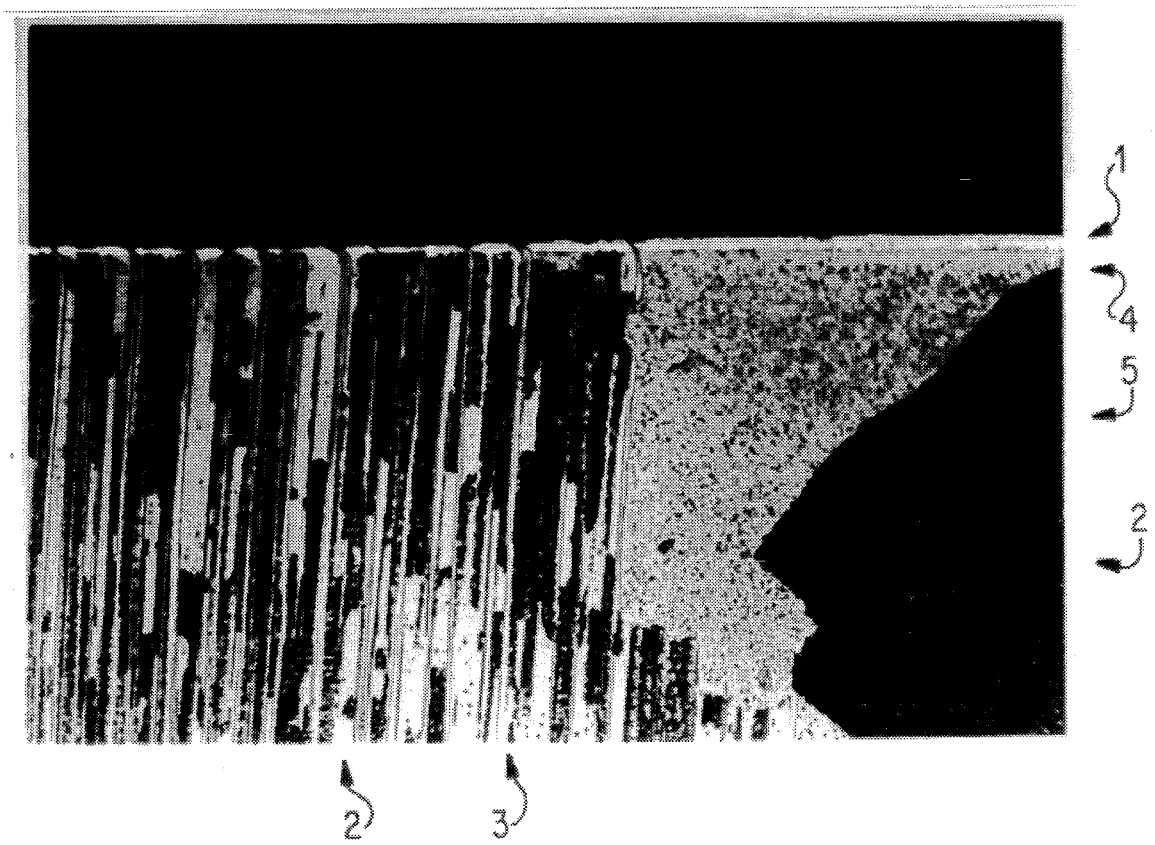
FIG. 2 PRIOR ART
FIG. 2 is a photograph of a metallurgical micrograph of a material according to FIG. 1 in the area of the cutout A.

FIG. 2 is the photo of a metallurgical micrograph of a material according to FIG. 1 in the area of the cutout A. For this purpose, a moving blade of an engine made of TiAl was coated in a powder pack system with a ternary alloy made of Ti/Al/C as an aluminum donor on its blade surface. The aluminum diffusion coating 1 shows considerable defects in the area of the crystallite 3 with a pronounced plate structure.

Figure 3:
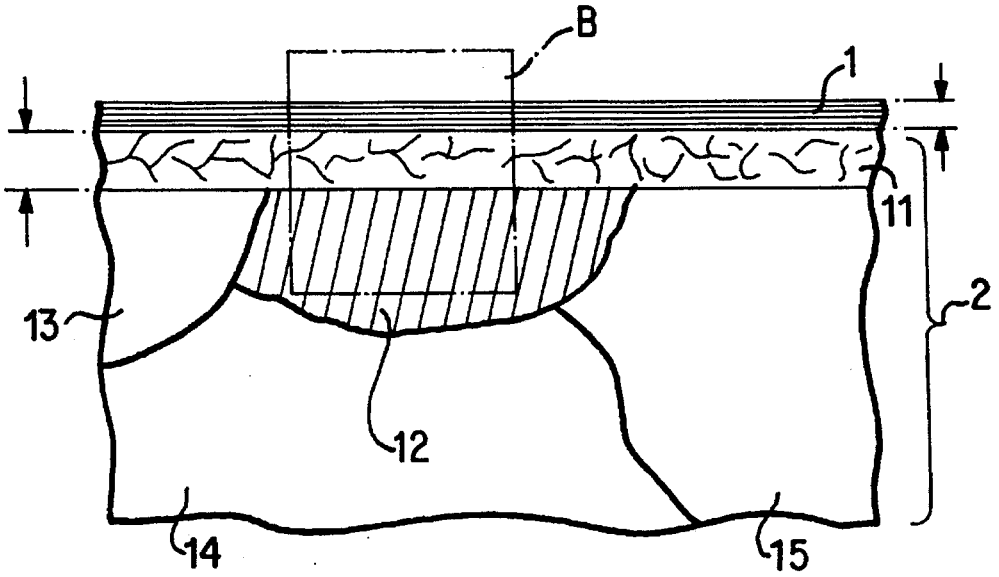
FIG. 3 is a view of an aluminum diffusion coating of components made of intermetallic compounds of titanium and aluminum with a zone which is close to the surface and which has a recrystallization structure.

FIG. 3 illustrates an aluminum diffusion coating 1 of components made of intermetallic compounds of titanium and aluminum with a zone 11 which is close to the surface and which has a recrystallization structure. The base material 2 exhibits large-volume crystallites 12 to 14. Crystallite 12 has a plate structure and crystallites 13 to 15 do not have a plate structure. In the proximity of the surface, the base material has a closed zone 11 with a recrystallization structure which is uniformly covered without fault points by a closed layer of aluminum. The outlined cutout B was examined by means of a metallographic section.

Figure 4:
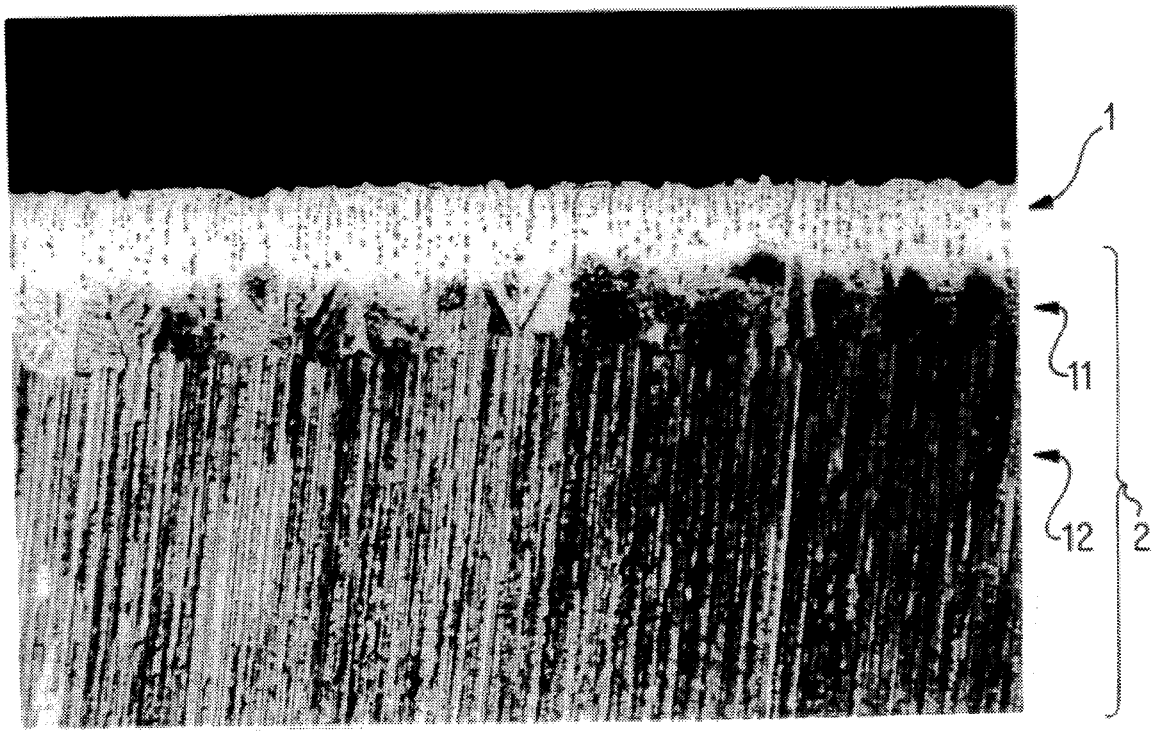
FIG. 4 is a photograph of a metallurgical micrograph of a material according to FIG. 3 in the area of the cutout B.

FIG. 4 is a photo of a metallurgical micrograph through a material according to FIG. 3 in the area of the cutout B. For this purpose, a guide blade of an engine made of 60% by volume TiAl and 40% by volume $Ti_3Al$ was first cold-formed on the surface to a depth of 5 μm by means of shot blasts, then recrystallization-annealed in an aluminum powder pack system, and finally provided with an aluminum diffusion coating 1 having a thickness of 5 μm. As illustrated in the metallurgical micrograph, a completely uniform aluminum coating 1 has grown evenly over the crystallite 12 with an originally extremely pronounced plate structure during the aluminum diffusion process in the aluminum powder pack system on the base material 2.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. Component made of a base material and having an aluminum diffusion coating on the base material, said base material being formed of an intermetallic compound formed of titanium and aluminum, or alloys of said intermetallic compound having alloying additions, the component comprising:

a closed zone between the base material and the aluminum diffusion coating, said closed zone being close to a surface of the base material and having a recrystallization structure.

2. Component according to claim 1, wherein the intermetallic compound is TiAl.

3. Component according to claim 1, wherein the intermetallic compound is an alloy of from 50 to 95% by volume TiAl with 5 to 50% by volume $Ti_3Al$.

4. Component according to claim 2, wherein the intermetallic compound is an alloy of from 50 to 95% by volume TiAl with 5 to 50% by volume $Ti_3Al$.

5. Component according to claim 1, wherein the intermetallic compound contains up to 4 atomic % alloying additions.

6. Component according to claim 5, wherein the alloying additions are selected from the group consisting of niobium, molybdenum, tantalum, tungsten, vanadium, or mixtures thereof.

7. Component according to claim 1, wherein a depth of the closed zone amounts to at least 0.1 μm.

8. Process for producing a component made of a base material and having an aluminum diffusion coating on the base material, said base material being formed of an intermetallic compound formed of titanium and aluminum, or alloys of said intermetallic compound having alloying additions, the process comprising the steps of:

cold-forming or slightly melting the component in a zone which is close to the surface of the base material;

annealing the component at recrystallization temperature; and applying an aluminum diffusion coating to a recrystallized zone formed in the annealing step.

9. Process according to claim 8, wherein the step of cold-forming a surface includes the step of one of shot blasting and machining surface areas of the component to be recrystallized.

10. Process according to claim 8, wherein using a heat cycle, a recrystallizing and an aluminum diffusion coating is carried out in that first the component cold-formed on the surface is heated to the recrystallization temperature in a system for aluminum diffusion coating and, after the recrystallization has taken place, the temperature is set for the aluminum diffusion coating and, at the same time, an aluminum-containing donor gas is supplied.

11. Process according to claim 9, wherein using a heat cycle, a recrystallizing and an aluminum diffusion coating is carried out in that first the component cold-formed on the surface is heated to the recrystallization temperature in a system for aluminum diffusion coating and, after the recrystallization has taken place, the temperature is set for the aluminum diffusion coating and, at the same time, an aluminum-containing donor gas is supplied.

12. Process according to claim 9, wherein the heat cycle to the feeding of the aluminum-containing donor gas takes place under protective gas or at a reduced pressure.

13. Process according to claim 10, wherein the heat cycle to the feeding of the aluminum-containing donor gas takes place under protective gas or at a reduced pressure.

14. Process according to claim 8, wherein the aluminum diffusion coating takes place by powder pack processes and, for generating a donor gas, an aluminum donor of the ternary alloy Ti/Al/C is used.

15. Process according to claim 9, wherein the aluminum diffusion coating takes place by powder pack processes and, for generating a donor gas, an aluminum donor of the ternary alloy Ti/Al/C is used.

16. Process according to claim 10, wherein the aluminum diffusion coating takes place by powder pack processes and, for generating a donor gas, an aluminum donor of the ternary alloy Ti/Al/C is used.

17. Process according to claim 12, wherein the aluminum diffusion coating takes place by powder pack processes and, for generating a donor gas, an aluminum donor of the ternary alloy Ti/Al/C is used.

* * * * *